US010663884B1

(12) United States Patent
Zhu et al.

(10) Patent No.: US 10,663,884 B1
(45) Date of Patent: May 26, 2020

(54) DEVELOPER SUPPLY CONTAINER AND DEVELOPER SUPPLY METHOD USING THE SAME

(71) Applicant: JIANGXI KILIDER TECHNOLOGY CO., LTD., Shangrao (CN)

(72) Inventors: Jinjun Zhu, Shangrao (CN); Zhongxi Li, Shangrao (CN); Jiabing He, Shangrao (CN)

(73) Assignee: JIANGXI KILIDER TECHNOLOGY CO., LTD., Shangrao (CN)

( * ) Notice: Subject to any disclaimer, the term of this patent is extended or adjusted under 35 U.S.C. 154(b) by 0 days.

(21) Appl. No.: 16/575,369

(22) Filed: Sep. 18, 2019

(30) Foreign Application Priority Data

Sep. 4, 2019 (CN) ..... 2019 1 0813795

(51) Int. Cl.
*G03G 15/08* (2006.01)
*G03G 21/16* (2006.01)

(52) U.S. Cl.
CPC ..... *G03G 15/0868* (2013.01); *G03G 21/1647* (2013.01); *G03G 2215/0675* (2013.01); *G03G 2221/163* (2013.01)

(58) Field of Classification Search
CPC ..... G03G 15/0886; G03G 21/1676; G03G 15/0872; G03G 15/0865
See application file for complete search history.

(56) References Cited

U.S. PATENT DOCUMENTS

2011/0217067 A1* 9/2011 Tokuno ..... G03G 15/0863 399/110
2014/0153974 A1* 6/2014 Jimba ..... G03G 15/0886 399/262
2016/0274535 A1* 9/2016 Suzuki ..... G03G 21/1676

* cited by examiner

*Primary Examiner* — Walter L Lindsay, Jr.
*Assistant Examiner* — Jessica L Eley

(57) ABSTRACT

The present disclosure provides a developer supply container and a developer supply method using the same. The developer supply container includes a container body, a piston rod and a piston sealing element. The piston sealing element is inserted into the container body; an outer side of an end of the piston rod is fixedly connected with a bolt; a first conductive iron sheet is provided near to a front side of an end of the bolt, a lower side of the first conductive iron sheet is provided with a second conductive iron sheet, and an end of each of the first conductive iron sheet and the second conductive iron sheet is electrically coupled with a processor chip fixed at the container body; and the end of the container body away from the piston rod is provided with a powder outlet deviating from a center of the container body.

8 Claims, 5 Drawing Sheets

DEVELOPER SUPPLY CONTAINER AND DEVELOPER SUPPLY METHOD USING THE SAME

TRAVERSE REFERENCE TO RELATED APPLICATION PROGRAMS

This application claims priority to Chinese Patent Application No. CN 201910813795.0, filed Sep. 4, 2019, which is hereby incorporated by reference herein as if set forth in its entirety.

BACKGROUND

1. Technical Field

The present disclosure relates to developer supply container technology, and particularly to a developer supply container and a developer supply method using the same.

2. Description of Related Art

Developer refers to a chemical for making latent images produced by the photosensitive material after exposure to form visible images. From the viewpoint of chemical components, developers can be classified into two major categories of inorganic compounds and organic compounds. The imaging of an image forming apparatus such as a copier or a printer cannot be realized without developer. Generally, the electrophotographic type image forming apparatus such as electrophotographic copiers use fine-particle type developers. In such an image forming apparatus, as a developer is consumed in the image forming process, it is necessary to replenish the developer using a developer supply container.

At present, when injecting the developer into the developer supply container, due to the developer supply container generally has a structure with inner and outer walls, a part of the developer may easily fly into or fall into the gap between the inner wall and the outer wall, which results in loss of the developer, while the smoothness of the movement of the piston member in the developer supply container will also be affected. In addition, when installing a fixing ring of the developer supply container, since the fixing ring is not buckled, there is a certain risk that the fixing ring restores to its original state, and there is also a certain risk that the fixing ring be pulled off. In this case, the piston member in the developer supply container will shake and eventually loosen, which will cause defection of product. Simultaneously, when assembling the piston member in the developer supply container after replenishing the developer into the developer supply container, due to the interior of the developer supply container is a sealed environment, there is great difficulty in installing the piston member in the developer supply container. Hence, it is a necessary to propose a new type of developer supply container to solve the problems in the prior art.

SUMMARY

An object of the present disclosure is to provide a developer supply container and a developer supply method using the same to solve the above-mentioned problems in the prior art that, at present, when injecting the developer into the developer supply container, due to the developer supply container generally has a structure with inner and outer walls, a part of the developer may easily fly into or fall into the gap between the inner wall and the outer wall, which results in loss of the developer, while the smoothness of the movement of the piston member in the developer supply container will also be affected. In addition, when installing a fixing ring of the developer supply container, since the fixing ring is not buckled, there is a certain risk that the fixing ring restores to its original state, and there is also a certain risk that the fixing ring be pulled off. In this case, the piston member in the developer supply container will shake and eventually loosen, which will cause defection of product. Simultaneously, when assembling the piston member in the developer supply container after replenishing the developer into the developer supply container, due to the interior of the developer supply container is a sealed environment, there is great difficulty in installing the piston member in the developer supply container.

In order to achieve the above-mentioned object, the present disclosure provides the technical solutions as follows.

The present disclosure provides a developer supply container, which includes a container body; a piston rod; and a piston sealing element; where, one end of the piston rod is provided with one or more first hooks each inserting into a first notch formed at an end of the piston sealing element; the piston sealing element is inserted into the container body; a first vent hole is formed at an end of the piston sealing element away from the piston rod, and the first vent hole has a rear end communicating a second vent hole penetrating a sidewall of the piston sealing element; an outer side of an end of the piston rod near to the piston sealing element is fixedly connected with a bolt slidable on an outer cylindrical surface of the container body; a first conductive iron sheet is provided near to a front side of an end of the bolt away from the piston rod, a lower side of the first conductive iron sheet is closely contacted with a second conductive iron sheet, the first conductive iron sheet and the second conductive iron sheet are both fixed on the outer cylindrical surface of the container body, and an end of each of the first conductive iron sheet and the second conductive iron sheet away from the bolt is electrically coupled with a processor chip fixed at an end of the container body away from the piston rod; and the end of the container body away from the piston rod is provided with a powder outlet deviating from a center of the container body.

In one embodiment, an outer side of a portion of the outer portion of the container body connecting with the piston rod is mounted with a fixing ring; a side of the fixing ring is provided with a handle; and an end of the handle is provided with a second hook inserted into a second notch formed on a side wall of the piston rod.

In one embodiment, the handle is formed with one or more anti-slip hollows.

In one embodiment, an upper end of the second vent hole is inserted with a vent plug formed with a slot.

In one embodiment, an outer cylindrical surface of an end of the piston sealing element away from the piston rod is sleeved with a rubber sealing ring closely contacting with an inner wall of the container body.

In one embodiment, an outer side of the bolt, the first conductive iron sheet, and the second conductive iron sheet are provided with a cover fixed on the outer cylindrical surface of the container body; and the cover is provided with an image mark.

In one embodiment, an outer side of the powder outlet is provided with a powder outlet cover inserted into the container body.

The present disclosure further provides a developer supply method, which includes steps of:

S1: filling a developer into the container body until the container body is filled up, removing the vent plug from the second vent, and inserting the piston sealing element into the container body through the piston rod;

S2: aligning and contacting the piston rod with an inlet of the container body, mounting the fixing ring on an outer side of the piston rod and the container body, and pressing the handle upward to make the second hook of the handle to be inserted into the second notch of the piston rod to fix the fixing ring and assemble the container body and the piston rod;

S3: when filling the developer into an image forming device, pulling the handle upward to separate the second hook from the second notch, removing the fixing ring to separate the container body from the piston rod, removing the powder outlet cover, putting the container body into the image forming device, and rotating the container body by 180 degrees so that the powder outlet of the container body matches an powder inlet of the image forming device;

S4: pushing the piston rod forward to make the piston rod driving the piston sealing element to move inside the container body in the direction of the powder outlet so that the develop in the container body to be filled into the image forming device through the powder outlet in the container body; and S5: pushing the bolt to move forward through the piston rod to insert the bolt between the first conductive iron sheet and the second conductive iron sheet so that the first conductive iron sheet and the second conductive iron sheet are separated to cut the power, providing feedback information of the image forming device through the processor chip in response to receiving a signal after power off stopping pushing the piston rod, rotating the container body by 180 degrees, and removing the container body from the image forming device.

In comparison with the prior art, the developer supply container provided by the present disclosure has the following advantages:

1. the present disclosure provides the container body which is designed as a style with a single wall without the inner and outer walls, so that the developer will not fly into or fall into the gap between the inner wall and the outer wall and result in loss of the developer when pouring into the container body, while the smoothness of the movement of the piston sealing element in the developer supply container body will also not be affected, thereby reducing wastes and achieving the convenient in usage;

2. the present disclosure provides with the handle on the fixing ring connecting the container body and the piston rod, where the handle is disposed with the second hook, and the second hook is inserted into the second notch on the piston rod to realize the fixing of the fixing ring for connecting the container body and the piston rod, so as to prevent the fixing ring from being pulled off or returning to the original position, thereby improving safety; and 3. the present disclosure provides the first vent hole and the second vent hole on the piston sealing element, so that the inner cavity of the container body communicates with the exterior through the first vent hole and the second vent hole when the piston sealing element is inserted into the container body, thereby achieving equal air pressure between the inner cavity and the outside world and facilitating the moving of the piston sealing element in the container body, which facilitates the pushing of the developer and is convenient for operations.

BRIEF DESCRIPTION OF THE DRAWINGS

To describe the technical schemes in the embodiments of the present disclosure more clearly, the following briefly introduces the drawings required for describing the embodiments or the prior art. Apparently, the drawings in the following description merely show some examples of the present disclosure. For those skilled in the art, other drawings can be obtained according to the drawings without creative efforts.

DETAILED DESCRIPTION

The technical solutions in the embodiments of the present disclosure will be clearly and completely described below in conjunction with the drawings in the embodiments of the present disclosure. Apparently, the following embodiments are only part of the embodiments of the present disclosure, not all of the embodiments of the present disclosure. The embodiments described herein are merely for illustrating the present disclosure and are not intended to limit the present disclosure. All other embodiments obtained by those skilled in the art without creative efforts are within the scope of the present disclosure.

Figure 1:
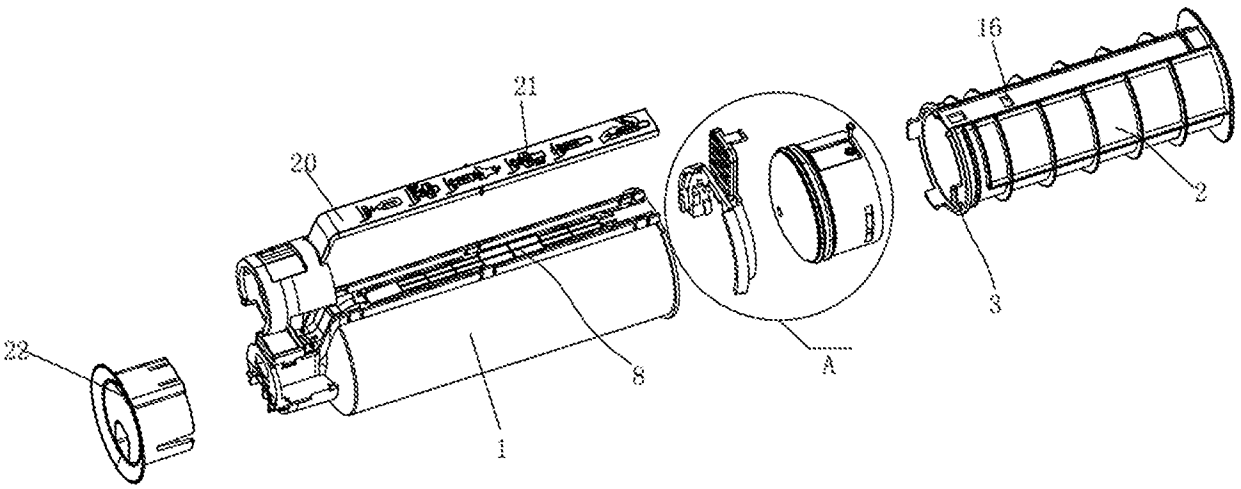
FIG. 1 is an exploded view of the structure of an embodiment of a developer supply container according to the present disclosure.
Figure 2:
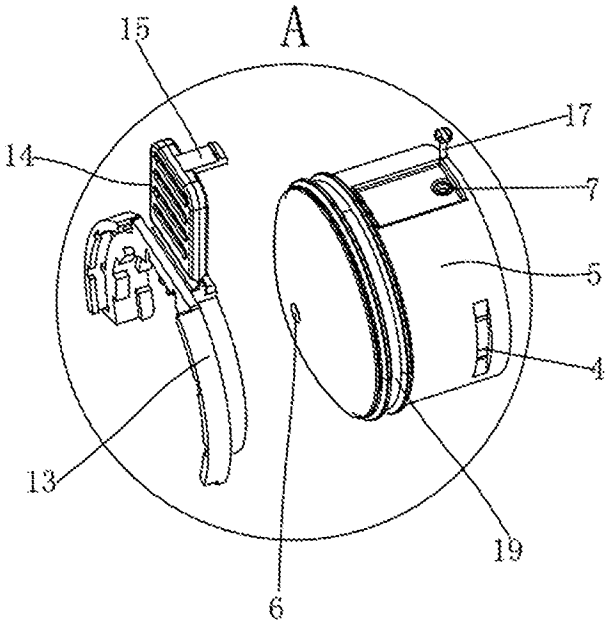
FIG. 2 is an enlarged view of the part A of FIG. 1.
Figure 4:
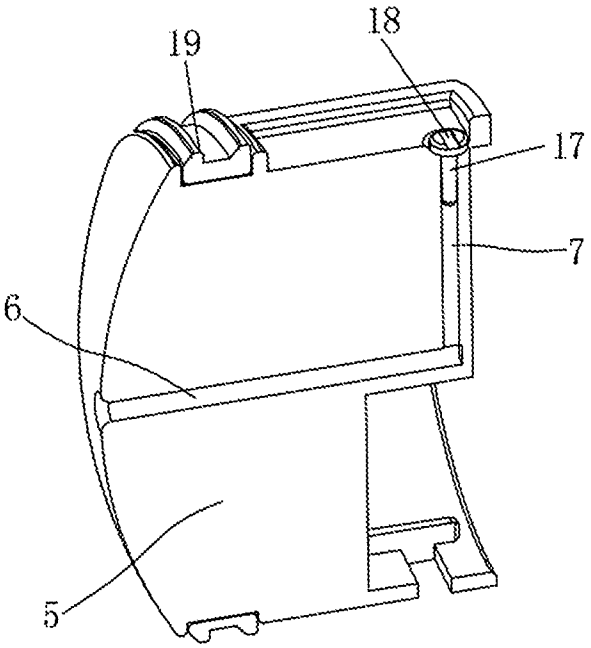
FIG. 4 is a schematic diagram of the internal structure of the piston sealing element of FIG. 1.

As shown in FIG. 1, FIG. 2, and FIG. 4, the present disclosure provides a developer supply container, which includes a container body 1, a piston rod 2, and a piston sealing element 5. One end of the piston rod 2 is provided with first hooks 3; each of the first hooks 3 is inserted into a first notch 4; the first notch 4 is formed at an end of the piston sealing element 5; and the piston sealing element 5 is inserted into the container body 1. A first vent hole 6 is formed at an end of the piston sealing element 5 away from the piston rod 2, and the first vent hole 6 has a rear end communicating a second vent hole 7, where the second vent hole 7 penetrates a sidewall of the piston sealing element 5, and a vent plug 17 is fixed at an upper end of the second vent hole 7. For facilitating the mounting and unmounting of the vent plug 17, a slot 18 is provided at an upper end of the vent plug 17 for mounting and unmounting through a tool. In order to prevent the developer from flowing out from the gap between the piston sealing element 5 and the inner wall of the container body 1, an outer side of the piston sealing element 5 is sleeved with a rubber sealing ring 19, in this embodiment, an outer cylindrical surface of an end of the piston sealing element 5 away from the piston rod 2 is sleeved with the rubber sealing ring 19, and the rubber sealing ring 19 closely contacts with an inner wall of the container body 1, thereby improving airtightness.

Figure 3:
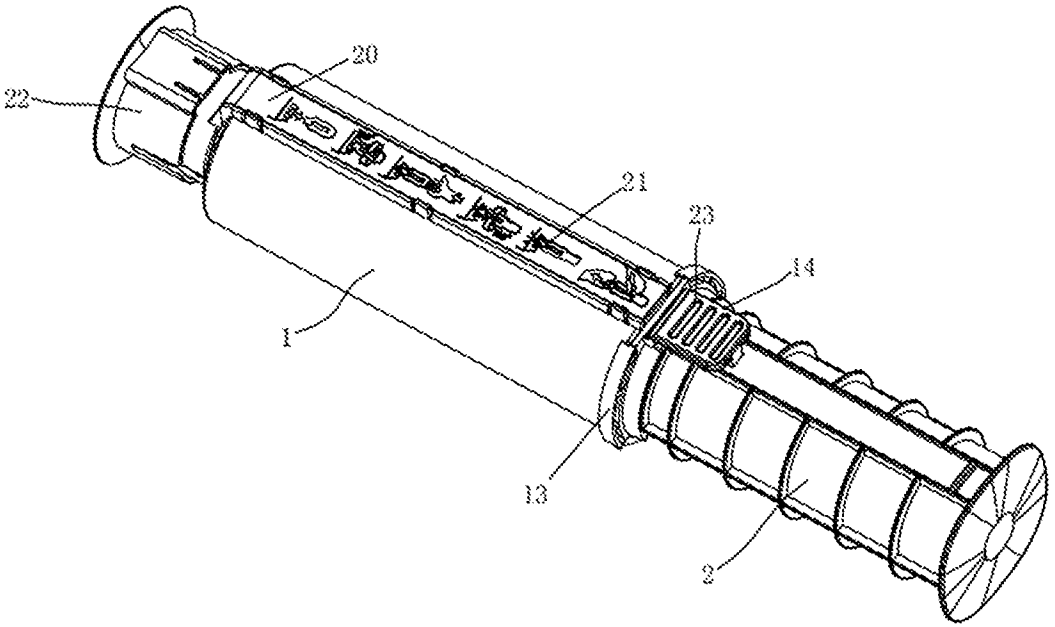
FIG. 3 is a perspective view of the developer supply container of FIG. 1.
Figure 5:
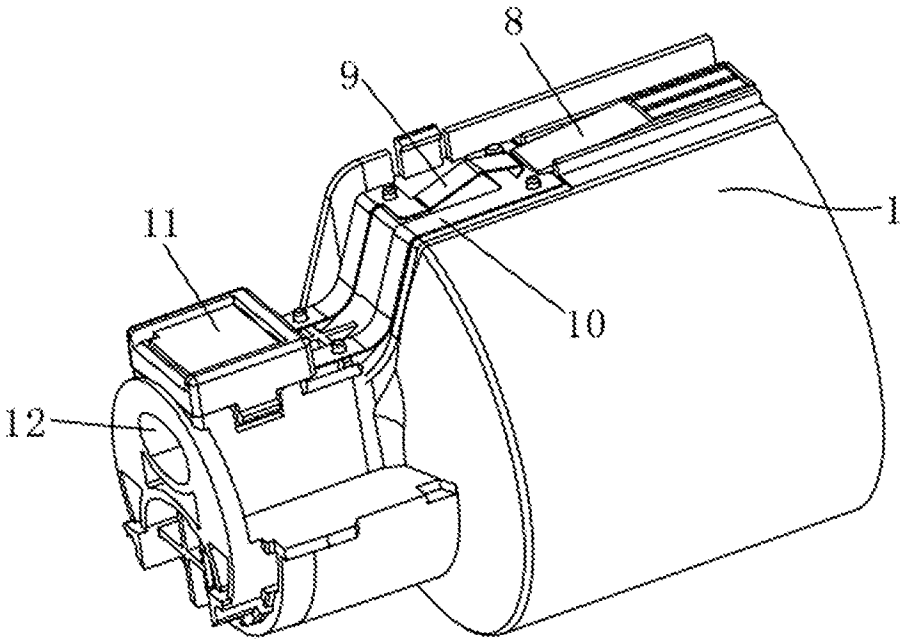
FIG. 5 is a schematic diagram of the structure of an end of the container body of FIG. 1.

As shown in FIG. 1, FIG. 3 and FIG. 5, an outer side of an end of the piston rod 2 near to the piston sealing element 5 is fixedly connected with a bolt 8; the bolt 8 is slidable on an outer cylindrical surface of the container body 1; a first conductive iron sheet 9 is provided near to a front side of an end of the bolt 8 away from the piston rod 2; a lower side of the first conductive iron sheet 9 is closely contacted with a second conductive iron sheet 10; the first conductive iron sheet 9 and the second conductive iron sheet 10 are both fixed on the outer cylindrical surface of the container body 1, and an end of each of the first conductive iron sheet 9 and the second conductive iron sheet 10 away from the bolt 8 is electrically coupled with a processor chip 11; an outer side of the bolt 8, the first conductive iron sheet 9, and the second conductive iron sheet 10 are provided with a cover 20, where the cover 20 is fixed on the outer cylindrical surface of the container body 1; and the cover 20 is provided with an image mark 21. Through the image mark 21, how the developer supply container to be operated can be understood quickly and accurately, which is convenient in usage.

As shown in FIG. 1 and FIG. 5, the processor chip 11 is fixed at an end of the container body 1 away from the piston rod 2. For allowing the developer to flow out of the container body 1, the end of the container body 1 away from the piston rod 2 is provided with a powder outlet 12, where the powder outlet 12 deviates from a center of the container body 1. In order to prevent the developer in the container body 1 from flowing out of the powder outlet 12 when there is no necessary to replenish the developer, an end of the container body 1 is mounted with a powder outlet cover 22. In this embodiment, the powder outlet cover 22 is installed at an outer side of the powder outlet 12, which is inserted into the container body 1.

As shown in FIG. 1, FIG. 2, and FIG. 3, in order to fix the container body 1 and the piston rod 2, an outer side of a portion of the container body 1 connecting with the piston rod 2 is mounted with a fixing ring 13; a side of the fixing ring 13 is provided with a handle 14; the handle 14 is formed with anti-slip hollows 23 to increase the friction between the hand and the handle 14 so as to facilitate the operating of the handle 14. An end of the handle 14 is provided with a second hook 15; the second hook 15 is inserted into a second notch 16, where the second notch 16 is formed on a side wall of the piston rod 2.

The present disclosure further provides a developer supply method, which includes the following steps:

S1: filling a developer into the container body 1 until the container body 1 is filled up, removing the vent plug 17 from the second vent 7, and inserting the piston sealing element 5 into the container body 1 through the piston rod 2;

S2: aligning and contacting the piston rod 2 with an inlet of the container body 1, mounting the fixing ring 13 on an outer side of the piston rod 2 and the container body 1, and pressing the handle 14 upward to make the second hook 15 of the handle 14 to be inserted into the second notch 16 of the piston rod 2 to fix the fixing ring 13 and assemble the container body 1 and the piston rod 2;

S3: when filling the developer into an image forming device, pulling the handle 14 upward to separate the second hook 15 from the second notch 16, removing the fixing ring 13 to separate the container body 1 from the piston rod 2, removing the powder outlet cover 22, putting the container body 1 into the image forming device, and rotating the container body 1 by 180 degrees so that the powder outlet 12 of the container body 1 matches an powder inlet of the image forming device;

S4: pushing the piston rod 2 forward to make the piston rod 2 driving the piston sealing element 5 to move inside the container body 1 in the direction of the powder outlet 12 so that the develop in the container body 1 to be filled into the image forming device through the powder outlet 12 in the container body 1 piston sealing element; and S5: pushing the bolt 8 to move forward through the piston rod 2 to insert the bolt 8 between the first conductive iron sheet 9 and the second conductive iron sheet 10 so that the first conductive iron sheet 9 and the second conductive iron sheet 10 are separated to cut the power, providing feedback information of the image forming device through the processor chip 11 in response to receiving a signal after power off, stopping pushing the piston rod 2, and rotating the container body 1 by 180 degrees, removing the container body 1 from the image forming device.

It should be noted that, the model and the specification of the processor chip 11 need to be determined according to the actual specifications of the developer supply container, and the specific method for selecting the model can adopt any suitable technique of the art, which will not be described in detail herein.

The power supplying of the processor chip 11 can adopt any suitable technique of the art, which will not be described in detail herein.

A process of using the developer supply container cab be, for example: first, pouring the developer into the container body 1 until the container body 1 is filled up, then removing the vent plug 17 from the second vent hole 7, and then inserting the piston sealing element 5 (by hand) into the container body 1 through the piston rod 2;

after the piston rod 2 is aligned and contacted with the inlet of the container body 1, the fixing ring 13 is mounted on the outer side of the piston rod 2 and the container body 1, and then the handle 14 is pushed upward to insert the second hook 15 of the handle 14 into the second notch 16 of the piston rod 2, thereby fixing the fixing ring 13 so as to assemble of the container body 1 and the piston rod 2;

when replenishing the developer to the image forming apparatus, the handle 14 is pulled upward to separate the second hook 15 from the second notch 16, the fixing ring 13 is removed so that the container body 1 is separated from the piston rod 2, and the powder outlet cover 22 is removed (from the container body 1), then the container body 1 is loaded into the image forming apparatus, and then the container body 1 is rotated by 180 degrees, so that the powder outlet 12 of the container body 1 is matched with the powder inlet of the image forming apparatus;

the piston rod 2 is pushed forward (by hand) to drive the piston sealing element 5 to move in the direction of the powder outlet 12 inside the container body 1, and the developer in the container body 1 is pushed by the piston sealing element 5 to enter the image forming apparatus through the powder outlet 12 of the container body 1, thereby replenishing the developer; and when the piston sealing element 5 is moved to the bottom end of the container body 1, that is, after the developer is replenished, the piston rod 2 pushes the bolt 8 to move forward, the bolt 8 is inserted between the first conductive iron sheet 9 and the second conductive iron sheet 10 so that the first conductive iron sheet 9 and the second conductive iron sheet 10 are separated from each other to serve as a power-off function, and since another end of each of the first conductive iron sheet 9 and the second conductive iron sheet 10 is electrically coupled with the processor chip 11, the feedback information of the image forming device is provided through the processor chip 11 in response to receiving the signal after power off, the pushing of the piston rod 2 is stopped, and the container body 1 is rotated by 180 degrees, and then the container body 1 can be removed from the image forming device to complete the filling of the developer.

It should be noted that, the forgoing is only embodiments of the present disclosure, which are not intended to limit the present disclosure. Although the present disclosure has been described in detail with reference to the foregoing embodiments, for those skilled in the art, modifications may be made to the technical schemes described in the above-mentioned embodiments, or some of the technical features may be equivalently replaced, while these modifications, equivalently replacements, improvements, or the like which are made within the spirit and principles of the present disclosure should all be included within the scope of the present disclosure.

What is claimed is:

1. A developer supply container, comprising:

a container body (1);

a piston rod (2); and a piston sealing element (5);

wherein, one end of the piston rod (2) is provided with one or more first hooks (3) each inserting into a first notch (4) formed at an end of the piston sealing element (5); the piston sealing element (5) is inserted into the container body (1); a first vent hole (6) is formed at an end of the piston sealing element (5) away from the piston rod (2), and the first vent hole (6) has a rear end communicating a second vent hole (7) penetrating a sidewall of the piston sealing element (5); an outer side of an end of the piston rod (2) near to the piston sealing element (5) is fixedly connected with a bolt (8) slidable on an outer cylindrical surface of the container body (1); a first conductive iron sheet (9) is provided near to a front side of an end of the bolt (8) away from the piston rod (2), a lower side of the first conductive iron sheet (9) is closely contacted with a second conductive iron sheet (10), the first conductive iron sheet (9) and the second conductive iron sheet (10) are both fixed on the outer cylindrical surface of the container body (1), and an end of each of the first conductive iron sheet (9) and the second conductive iron sheet (10) away from the bolt (8) is electrically coupled with a processor chip (11) fixed at an end of the container body (1) away from the piston rod (2); and the end of the container body (1) away from the piston rod (2) is provided with a powder outlet (12) deviating from a center of the container body (1).

2. The developer supply container of claim 1, wherein an outer side of a portion of the container body (1) connecting with the piston rod (2) is mounted with a fixing ring (13); a side of the fixing ring (13) is provided with a handle (14); and an end of the handle (14) is provided with a second hook (15) inserted into a second notch (16) formed on a side wall of the piston rod (2).

3. The developer supply container of claim 2, wherein the handle (14) is formed with one or more anti-slip hollows (23).

4. The developer supply container of claim 1, wherein an upper end of the second vent hole (7) is inserted with a vent plug (17) formed with a slot (18).

5. The developer supply container of claim 1, wherein an outer cylindrical surface of an end of the piston sealing element (5) away from the piston rod (2) is sleeved with a rubber sealing ring (19) closely contacting with an inner wall of the container body (1).

6. The developer supply container of claim 1, wherein an outer side of the bolt (8), the first conductive iron sheet (9), and the second conductive iron sheet (10) are provided with a cover (20) fixed on the outer cylindrical surface of the container body (1); and the cover (20) is provided with an image mark (21).

7. The developer supply container of claim 1, wherein an outer side of the powder outlet (12) is provided with a powder outlet cover (22) inserted into the container body (1).

8. A developer supply method using the developer supply container of claim 1, comprising steps of:

S1: filling a developer into the container body (1) until the container body (1) is filled up, removing the vent plug (17) from the second vent (7), and inserting the piston sealing element (5) into the container body (1) through the piston rod (2);

S2: aligning and contacting the piston rod (2) with an inlet of the container body (1), mounting the fixing ring (13) on an outer side of the piston rod (2) and the container body (1), and pressing the handle (14) upward to make the second hook (15) of the handle (14) to be inserted into the second notch (16) of the piston rod (2) to fix the fixing ring (13) and assemble the container body (1) and the piston rod (2);

S3: when filling the developer into an image forming device, pulling the handle (14) upward to separate the second hook (15) from the second notch (16), removing the fixing ring (13) to separate the container body (1) from the piston rod (2), removing the powder outlet cover (22), putting the container body (1) into the image forming device, and rotating the container body (1) by 180 degrees so that the powder outlet (12) of the container body (1) matches an powder inlet of the image forming device;

S4: pushing the piston rod (2) forward to make the piston rod (2) driving the piston sealing element (5) to move inside the container body (1) in the direction of the powder outlet (12) so that the develop in the container body (1) to be filled into the image forming device through the powder outlet (12) in the container body (l) piston sealing element; and S5: pushing the bolt (8) to move forward through the piston rod (2) to insert the bolt (8) between the first conductive iron sheet (9) and the second conductive iron sheet (10) so that the first conductive iron sheet (9) and the second conductive iron sheet (10) are separated to cut the power, providing feedback information of the image forming device through the processor chip (11) in response to receiving a signal after power off, stopping pushing the piston rod (2), rotating the container body (1) by 180 degrees, and removing the container body (1) from the image forming device.

* * * * *